United States Patent [19]

Harnsberger

[11] 4,066,127

[45] Jan. 3, 1978

[54] PROCESSES FOR PRODUCING BITUMEN FROM TAR SANDS AND METHODS FOR FORMING A GRAVEL PACK IN TAR SANDS

[75] Inventor: Bobby G. Harnsberger, Houston, Tex.

[73] Assignee: Texaco Inc., New York, N.Y.

[21] Appl. No.: 716,503

[22] Filed: Aug. 23, 1976

[51] Int. Cl.[2] ..... E21B 43/24; E21B 43/08; E21B 43/10

[52] U.S. Cl. ..... 166/278; 166/303; 166/306

[58] Field of Search ..... 166/278, 276, 288, 303, 166/272, 256, 257, 314, 315, 306

[56] References Cited

U.S. PATENT DOCUMENTS

| | | | |
|---|---|---|---|
| 2,652,117 | 9/1953 | Arendt et al. | 166/278 |
| 2,677,428 | 5/1954 | Clark | 166/278 |
| 2,905,245 | 9/1959 | De Priester | 166/250 |
| 3,126,961 | 3/1964 | Craig, Jr. et al. | 166/306 X |
| 3,180,414 | 4/1965 | Parker | 166/303 X |
| 3,367,420 | 2/1968 | Jennings et al. | 166/276 |
| 3,379,247 | 4/1968 | Santourian | 166/272 |
| 3,804,172 | 4/1974 | Closmann et al. | 166/303 X |
| 3,913,671 | 10/1975 | Redford et al. | 166/252 |
| 3,964,547 | 6/1976 | Mujsak et al. | 166/303 X |

*Primary Examiner*—Stephen J. Novosad
*Attorney, Agent, or Firm*—Carl G. Ries; Thomas H. Whaley; Theron H. Nichols

[57] ABSTRACT

Process for producing bitumen from a subterranean reservoir of tar sands comprises heating the casing for melting the bitumen from the tar sands adjacent the casing for forming a passage in the reservoir from upper perforations at the top of the reservoir to lower perforations at the bottom of the reservoir, setting a packer in an annulus between the casing and a tubing therein between the upper and lower perforations, circulating hot fluids from the upper perforations and back into lower perforations for melting more bitumen from the tar sands for forming a predetermined size cavity around the casing, adding a packer and a screen to the tubing, ejecting a gravel pack material slurry into the cavity around the screen, ejecting more hot fluids into the cavity for melting more bitumen from the tar sands, and flowing the melted bitumen through the gravel pack, lower perforations, and screen for filtering out the sand and gravel from the melted bitumen for recovering the melted bitumen at the surface. A modification of the above process is disclosed.

Two new methods for forming a gravel pack in a subterranean reservoir of tar sands are disclosed.

16 Claims, 4 Drawing Figures

PROCESSES FOR PRODUCING BITUMEN FROM TAR SANDS AND METHODS FOR FORMING A GRAVEL PACK IN TAR SANDS

BACKGROUND OF THE INVENTION

The control of heavy oil or tar sands or sand suspended in oil or where tar is the matrix is difficult as the conventional sand control and production methods are not adequate and effective. In tar sands, the sand becomes unconsolidated after the oil or tar is removed. The formation is consolidated oil or bitumen until the oil or bitumen is produced. The problem in tar sands is the undesirable production of sand with the oil or bitumen which is detrimental to most equipment, and particularly to the pumps.

U.S. Pat. No. 3,379,247 circulates hot fluids between lower and upper perforations in a tar sand formation, but it also produces sand with the melted bitumen which is detrimental to most mechanical equipment above, as the hydraulic pumps, etc. Assignee's U.S. Pat. No. 3,913,671 discloses circulating an aqueous heating fluid with sodium hydroxide out upper perforations and in lower perforations after packing through a sand pack. But this disclosure lacks the steps of inserting a screen in the apex of the cone of the gravel pack and ejecting hot fluids into the cavity for providing an improved method of sand control and production of bitumen. U.S. Pat. No. 2,905,245 likewise lacks the screen and gravel pack therewith for providing an improved method for hydrocarbon production in tar sands.

OBJECTS OF THE INVENTION

Accordingly, a primary object of this invention is to provide an improved process for producing petroleum such as bitumen from a subterranean reservoir of very viscous, semi-solid, immobile hydrocarbon material, such as tar sands, that is economical, practical, and provides uninterrupted and continuous recovery of petroleum from the formation.

Another object of this invention is to provide an improved method for forming a gravel pack in a subterranean reservoir of tar sands, that is economical, practical, and reliable.

A further object of this invention is to provide two methods for forming an improved gravel pack and two methods for producing bitumen that are easy to operate, comprise simple method steps, are economical to utilize and operate, and are of greater efficiency for the production of hydrocarbons.

Other objects and various advantages of the disclosed processes for producing bitumen from tar sands and methods for forming a gravel pack in tar sands will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, a few forms for carrying out the methods of the invention wherein like reference numerals have been employed to indicate similar parts in the several views in which.

The invention disclosed herein, the scope of which being defined in the appended claims, is not limited in its application to the details of construction and arrangement of parts shown and described for carrying out the disclosed methods, since the invention is capable of other embodiments for carrying out other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

This invention comprises a few methods for producing bitumen from tar sands and a few methods for forming a gravel pack in tar sands.

PROCESSES FOR PRODUCING BITUMEN FROM TAR SANDS

Figure 1:
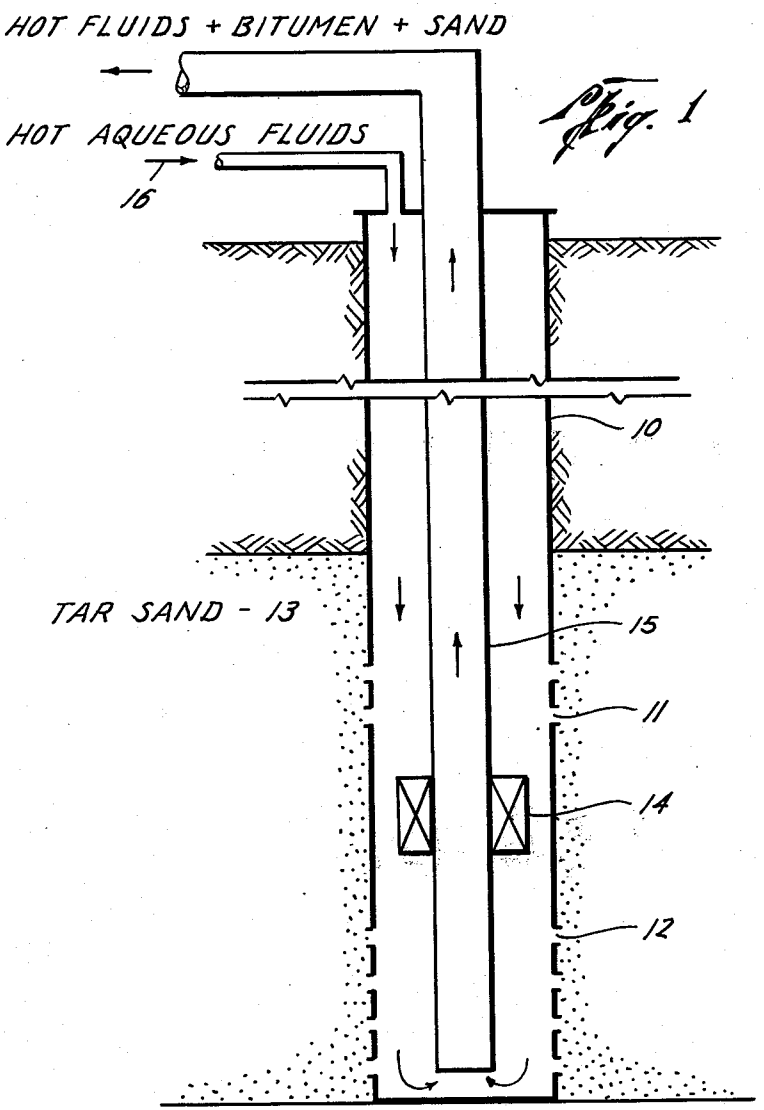
FIG. 1 is a schematic vertical sectional view of a well through a subterranean reservoir of tar sands illustrating the first step of heating the casing for forming a passage in the reservoir from the upper perforations to the lower perforations.

One aspect of this invention is the production and recovery of viscous petroleum or bitumen from subterranean viscous petroleum-containing formations including tar sand formations by contacting these immobile hydrocarbon deposits in the formation near the production well to facilitate removal thereof from the formation. Thus in greater detail, one method comprises the process steps of:

1. Lining a well with a casing 10 as illustrated in FIG. 1, which is perforated with a set of perforations 11 at the top of the formation 13 containing tar sand and a set of perforations 12 at the lower portion of the tar sand formation. A packer 14 is run down the tubing and positioned in inactive position between the upper and lower perforation whereby fluid may pass for the full length of an annulus formed by a tubing 15 internally of the casing 10.

2. Heating the casing 10, FIG. 1, for melting the bitumen from the tar sands immediately adjacent the external surface of the casing to allow formation of a passage in the tar sand reservoir formation 13 from the upper perforations to the lower perforations. In this invention a source of heated aqueous fluid 16 such as hot water, steam, or superheated steam is injected into the annulus from a suitable source for passing down the annulus beside the tubing 15 to the bottom of the casing 10 where it enters the bottom of the tubing and returns to the surface, thus heating the sides of the casing 10 and accordingly the tar sand in contact with the outer surface of the casing. The bitumen is thus melted in contact with the outer surface of the casing and runs down with any condensed steam to the lower perforations by gravity. Thus, passages are established between the upper and lower perforations just on the external surface of the casing in contact with the formation. A suitable pump (not shown) on the surface forces the produced petroleum or bitumen sand, and fluids from the tubing 15.

Figure 2:
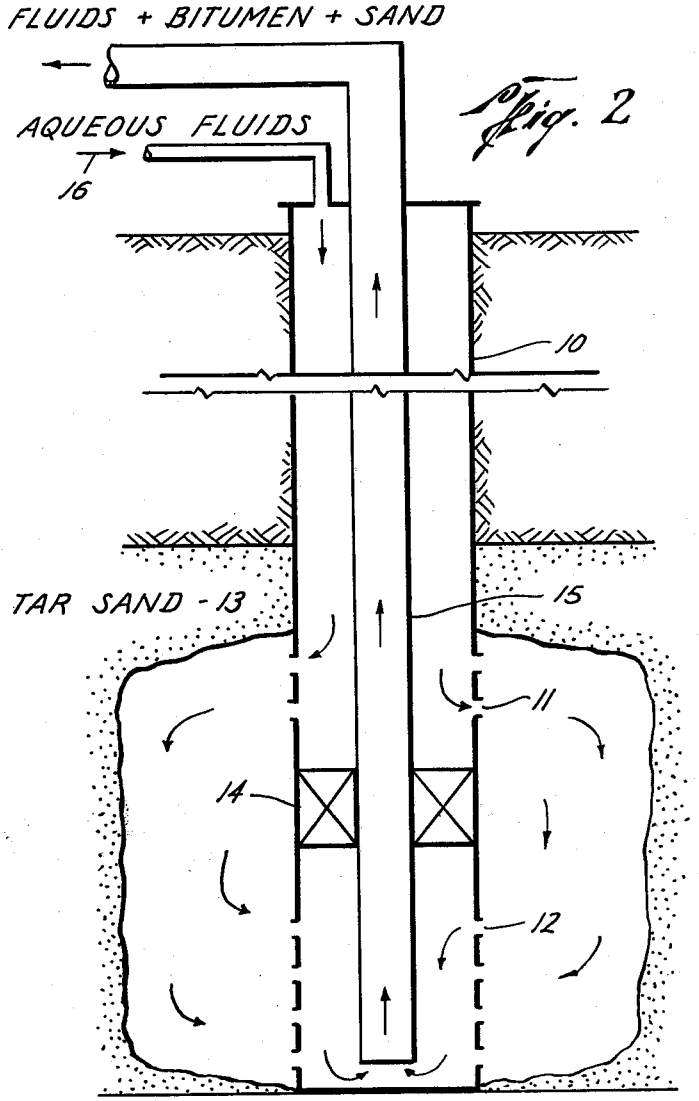
FIG. 2 is the well of FIG. 1 after a packer is set and more hot fluids are being circulated to melt out the bitumen from the tar sands formation for forming a cavity for a sand pack.

3. This step comprises running a packer or if the packer is already there, setting the packer 14, as illustrated in FIG. 2, to prevent internal fluid communication between the upper and lower perforations 11 and 12, respectively, of the casing.

4. The next step comprises injecting an aqueous or hot fluid such as hot water, steam, or superheated steam from the upper perforations 11, FIG. 2, for melting more bitumen from the tar sands 13 for flowing through the lower perforations 12 for forming a cavity of predetermined size around the casing, flowing from the upper perforations down to the lower perforations and up through the tubing for recovery at the surface, as illustrated in FIG. 2. In greater detail, this step comprises ejecting hot fluid from the upper perforations in the annulus into the cavity in the tar sand for breaking the tar sands down into melted bitumen and bitumen-bare sand, then flowing the bitumen, bitumen-bare sand, and the hot injected fluids toward the lower perforations for melting out a cavity around the casing of a predetermined size from the upper perforations to the lower perforations. The size of this cavity is determined by the measured amount of bitumen produced from the tubing in the well when making this cavity for use in later steps.

5. The tubing with the packer thereon is pulled out of the well.

6. The tubing 15 with a screen 17, FIG. 3, on the open bottom thereof is then run back in the well 10 to a position where the screen is adjacent to lower perforations 12 and the packer 14 is then set between the upper and lower perforations.

Figure 3:
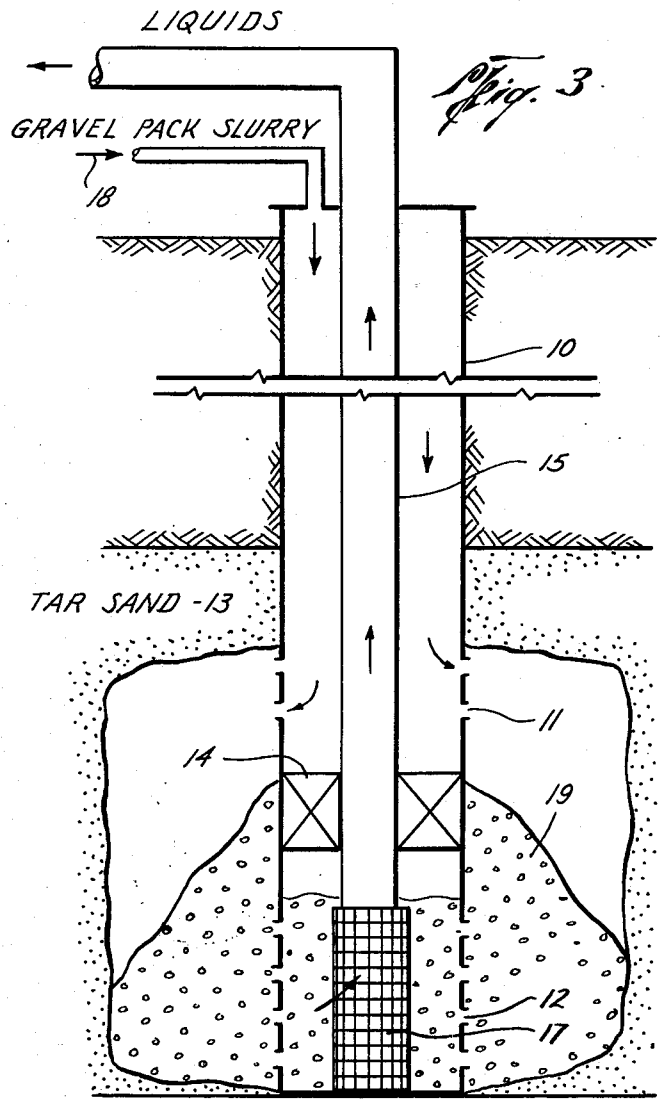
FIG. 3 is the well of FIG. 2 when forming the sand pack in the cavity.

7. A gravel pack material slurry 18 is then injected into the cavity from the upper perforations 11 for forming or pressure packing a gravel pack 19 around the screen 17 as shown in FIG. 3. This gravel pack slurry is introduced into the annulus from the top of the well and poured down and passed out the upper perforations to form the gravel pack over the lower perforations and screen. This screen 17 is essential to retain the pack sand or gravel in position so that formation sand will not be produced with the bitumen, but will be filtered out on the outer surface of the pack sand or gravel.

Figure 4:
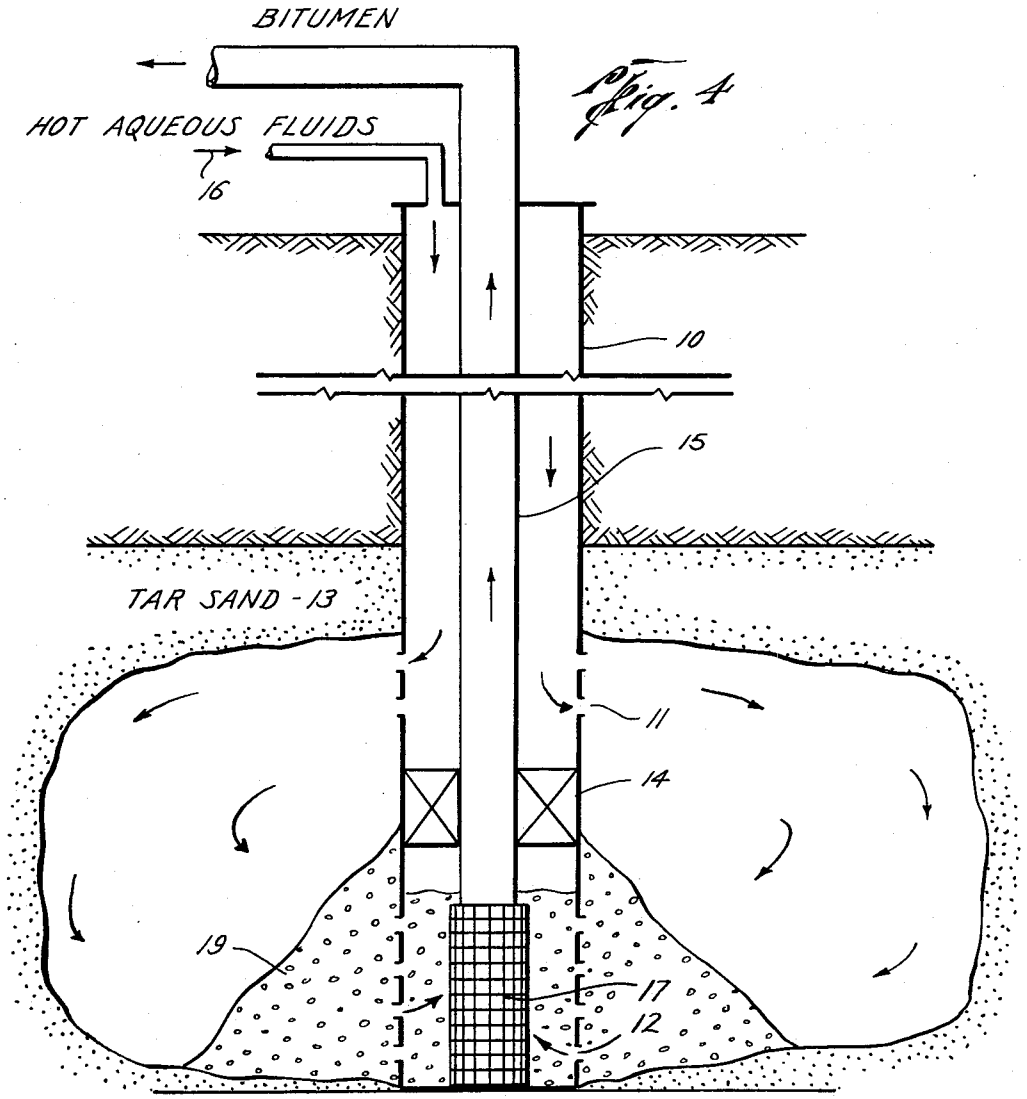
FIG. 4 is the well of FIG. 3 after the sand pack is finished and bitumen is being produced with the circulation of hot fluids.

8. More hot fluids 16 such as hot water, or steam are injected into the cavity as illustrated in FIG. 4 from suitable source above through the annulus and then through the upper perforations 11 to circulate around in the cavity for melting the bitumen from the tar sand 13.

9. Flowing the melted bitumen through the gravel pack 19, lower perforations 12, and screen 17 for filtering out the sand and the gravel from the melted bitumen for recovery at the surface after having been pumped up through the tubing.

A second method for producing bitumen from a subterranean reservoir of tar sand from a well having a tubing centered in a casing forming an annulus with sets of perforations therein the casing at the top and bottom of the reservoir comprises the first step of heating the casing at the beginning or melting the bitumen from the tar sand immediately adjacent the external surface of the casing to allow formation of a passage in the reservoir from the upper perforations to the lower perforations, thus eliminating the step of inserting a packer at this point. The rest of the steps are similar to the first method.

METHODS FOR FORMING A GRAVEL PACK IN TAR SANDS

One method for forming a gravel pack for producing bitumen from a subterranean reservoir of tar sands from a well therein having tubing centered in a casing forming an annulus with perforations at the top and bottom of the reservoir comprises the steps of:

1. running a packer 14, FIG. 1, in the annulus between the upper and lower perforations 11, 12, 2. heating the casing for melting the bitumen from the tar sands immediately adjacent the external surface of the casing 10 to form a passage in the reservoir 13 from the upper perforations 11 to the lower perforations 12, 3. setting the packer 14, FIG. 2, to prevent internal fluid communication between the upper and lower perforations 11, 12, 4. ejecting hot fluids 16 from the upper perforations 11 for melting more bitumen from the tar sands 13 for flowing through the lower perforations 12 for forming a cavity of a predetermined size around the casing 10 from the upper perforations 11 to the lower perforations 12 and through the tubing 15 for recovery at the surface, 5. pulling out the tubing 15, FIG. 2, and packer 14, 6. running the tubing with a screen 17, FIG. 3, on the bottom thereof adjacent the lower perforations setting the packer, 7. ejecting a gravel pack material slurry 18 of a volume substantially equal to the amount of melted bitumen recovered at the surface into the cavity from the upper perforations 11 for forming a long lasting gravel pack 19 around the screen 17.

Another method of forming a gravel pack for producing bitumen from the subterranean reservoir of tar sands from a well therein having tubing centered in a casing forming an annulus with sets of perforations therein at the top and bottom of the reservoir comprising the steps of, 1. heating the casing 10, FIG. 1, for melting the bitumen from the tar sands 13 immediately adjacent the external surface of the casing to form a passage in the reservoir from the upper perforations 11 to the lower perforations 12, 2. setting a packer 14, FIG. 2, between the tubing 15 and casing 10 for preventing internal fluid communication between the sets of upper and lower perforations 11, 12, 3. ejecting hot fluids 16, FIG. 2, from one of the sets of perforations for melting more bitumen from the tar sands 13 for flowing through the other set of perforations for recovery at the surface and for forming a cavity of a predetermined size around the casing 10 from the upper perforations 11 to the lower perforations 12, 4. pulling out the tubing 15, FIG. 2, and packer 14, 5. re-running the tubing 15 with a screen 17 thereon adjacent the one set of perforations and resetting the packer 14 between the two sets of perforations 11, 12, and 6. ejecting a gravel slurry 18, FIG. 3, of a volume substantially equal to the amount of melted bitumen recovered at the surface into the cavity from the one set of perforations for forming a gravel pack 19 around the screen 17 for forming a long lasting gravel pack in tar sands.

The above basic step (3) may be broken down into the following method steps:

1. ejecting hot fluid from one of the sets of perforations in the casing into the tar sands for breaking the tar sands down into melted bitumen and bitumen-bare sand, 2. flowing the bitumen, bitumen-bare sand, and the hot injected fluids toward the other set of perforations for melting out a cavity of a predetermined size around the casing from the upper set of perforations to the lower set of perforations, and 3. flowing the bitumen, bitumen-bare sand, and injected fluids through the other set of perforations for recovery at the surface.

Likewise the above basic step (3) may be broken down further as follows:

1. ejecting hot fluids from the upper set of perforations in the casing into the tar sands for breaking the tar sands down into melted bitumen and bitumen-bare sand, 2. flowing the bitumen, bitumen-bare sand, and the hot injected fluids toward the lower set of perforations for melting out a cavity of a predetermined size around the casing from the upper set of perforations to the lower set of perforations, and 3. flowing the bitumen, bitumen-bare sand, and injected fluids through the lower set of perforations for recovery at the surface.

Another and different method for forming a gravel pack in tar sands may be obtained by substituting the following method steps for the basic method step (3):

1. ejecting hot fluid from the lower set of perforations in the annulus into the tar sands for breaking the tar sands down into melted bitumen and bitumen-bare sand, 2. flowing the bitumen, bitumen-bare sand, and the hot injected fluids toward the upper set of perforations for melting out a cavity of a predetermined size around the casing from the lower set of perforations to the upper set of perforations, and 3. flowing the bitumen, bitumen-bare sand, and injected fluids through the upper set of perforations for recovery at the surface.

Accordingly, it will be seen that a few methods for producing bitumen from tar sands and a few methods for forming a gravel pack in tar sands have been described which will operate in a manner which meets each of the objects set forth hereinbefore.

While only a few methods of the invention have been disclosed, it will be evident that various other methods and modifications are possible without departing from the scope of the invention and it is accordingly desired to comprehend within the purview of this invention such methods and modifications as may be considered to fall within the scope of the appended claims.

I claim:

1. A process for producing bitumen from a subterranean reservoir of tar sands from a well having tubing centered in a casing forming an annulus with perforations at the top and bottom of the reservoir comprising the steps of, a. running a packer in the annulus between the upper and lower perforations in the casing, b. heating the casing for melting the bitumen from the tar sands immediately adjacent the external surface of the casing to form a passage in the reservoir from the upper perforations to the lower perforations, c. setting the packer to prevent internal fluid communication between the upper and lower perforations, d. ejecting hot fluids from the upper perforations for melting more bitumen from the tar sands for flowing through the lower perforations for forming a cavity of a predetermined size around the casing from the upper perforations to the lower perforations and through the tubing for recovery at the surface, e. mounting a screen on the bottom of the tubing adjacent the lower perforations and setting the packer, f. ejecting a gravel pack material slurry into the cavity from the upper perforations for forming a gravel pack around the screen, g. ejecting more hot fluids into the cavity from the upper perforations for melting more bitumen from the tar sands, and h. flowing the melted bitumen through the gravel pack, lower perforations, and screen for filtering out sand and gravel from the melted bitumen for recovering the melted bitumen at the surface.

2. A process as recited in claim 1 wherein the second step comprises further, a. flowing hot fluids down the annulus past the upper perforations to the lower perforations and back up the tubing for melting the bitumen surrounding the casing for forming the passage in the reservoir from the upper perforations to the lower perforations.

3. A process as recited in claim 1 wherein the fourth step comprises further, a. ejecting hot fluids from the upper perforations in the casing into the tar sands for breaking the tar sand down into melted bitumen and bitumen-bare sand, b. flowing the bitumen, bitumen-bare sand, and the hot injected fluids toward the lower perforations for melting out a cavity around the casing of a predetermined size from the upper perforations to the lower perforations, and c. flowing the bitumen, bitumen-bare sand, and injected fluids into the lower end of the tubing for recovery at the surface.

4. A process for producing bitumen from a subterranean reservoir of tar sands from a well having a tubing centered in a casing forming an annulus with sets of perforations therein at the top and bottom of the reservoir comprising the steps of, a. heating the casing for melting the bitumen from the tar sands immediately adjacent the external surface of the casing to form a passage in the reservoir from the upper perforation to the lower perforations, b. setting a packer between the tubing and casing for preventing internal fluid communication between the sets of upper and lower perforations, c. ejecting hot fluids from one of the sets of perforations for melting more bitumen from the tar sands for flowing through the other set of perforations for recovery at the surface and for forming a cavity of a predetermined size around the casing from the upper perforations to the lower perforations, d. pulling out the tubing and packer, e. re-running the tubing with a screen thereon adjacent the other set of perforations and resetting the packer between the two sets of perforations, f. ejecting a gravel slurry into the cavity from the one set of perforations for forming a gravel pack around the screen adjacent the other set of perforations, g. ejecting more hot fluids into the cavity from the one set of perforations for melting more bitumen from the tar sands, and h. flowing the melted bitumen through the gravel pack, the other set of perforations, and screen for filtering out sand and gravel from the melted bitumen for recovery of the bitumen at the surface.

5. A process as recited in claim 4 wherein the first step comprises further, a. flowing hot fluids down the annulus past the upper perforations to the lower perforations and back up the tubing for melting the bitumen surrounding the casing for forming the passage in the reservoir from the upper perforations to the lower perforations.

6. A process as recited in claim 4 wherein the third step comprises further, a. ejecting hot fluid from the one of the sets of perforations in the annulus into the tar sand for breaking the tar sands down into melted bitumen and bitumen-bare sand, b. flowing the bitumen, bitumen-bare sand, and the hot injected fluids toward the other set of perforations for melting out a cavity of a predetermined size around the casing from the upper set of perforations to the lower set of perforations, and c. flowing the bitumen, bitumen-bare sand, and injected fluids through the other set of perforations for recovery at the surface.

7. A process as recited in claim 4 wherein the third step comprises further, a. ejecting hot fluids from the upper set of perforations in the casing into the tar sands for breaking the tar sands down into melted bitumen and bitumen-bare sand, b. flowing the bitumen, bitumen-bare sand, and the hot injected fluids toward the lower set of perforations for melting out a cavity of a predetermined size around the casing from the upper set of perforations to the lower set of perforations, and c. flowing the bitumen, bitumen-bare sand, and injected fluids through the lower set of perforations for recovery at the surface.

8. A method for forming a gravel pack for producing bitumen from a subterranean reservoir of tar sands from a well therein having tubing centered in a casing forming an annulus with sets of perforations therein at the top and bottom of the reservoir comprising the steps of, a. running a packer in the annulus between the upper and lower perforations, b. heating the casing for melting the bitumen from the tar sands immediately adjacent the external surface of the casing to form a passage in the reservoir from the upper perforations to the lower perforations, c. setting the packer to prevent internal fluid communication between the upper and lower perforations, d. ejecting hot fluids from the upper perforations for melting more bitumen from the tar sands for flowing through the lower perforations for forming a cavity of a predetermined size around the casing from the upper perforations to the lower perforations and through the tubing for recovery at the surface, e. pulling out the tubing and packer, f. running the tubing with a screen on the bottom thereof adjacent the lower perforations and setting the packer, and g. ejecting a gravel pack material slurry into the cavity from the upper perforations for forming a gravel pack around the screen that is a long lasting gravel pack in tar sands.

9. A method as recited in claim 8 wherein the second method step comprises further, a. flowing hot fluids down the annulus past the upper perforations to the lower perforations and back up the tubing for melting the bitumen surrounding the casing for allowing formation of a passage in the reservoir from the upper perforations to the lower perforations.

10. A method as recited in claim 8 wherein the fourth method step comprises further, a. ejecting hot fluids from the upper perforations in the casing into the tar sands for breaking the tar sand down into melted bitumen and bitumen-bare sand, b. flowing the bitumen, bitumen-bare sand, and the hot injected fluids toward the lower perforations for melting out a cavity around the casing of a predetermined size from the upper perforations to the lower perforations, and c. flowing the bitumen, bitumen-bare sand, and injected fluids into the lower end of the tubing for recovery at the surface.

11. A method as recited in claim 8 wherein the last method step comprises, a. ejecting substantially the same amount of gravel pack material from the upper perforations into the cavity as the amount of melted bitumen recovered at the surface for forming a long-lasting gravel pack in tar sands.

12. A method for forming a gravel pack for producing bitumen from a subterranean reservoir of tar sands from a well therein having tubing centered in a casing forming an annulus with sets of perforations at the top and bottom of the reservoir comprising the steps of, a. heating the casing for melting the bitumen from the tar sands immediately adjacent the external surface of the casing to allow formation of a passage in the reservoir from the upper perforations to the lower perforations, b. setting a packer between the tubing and casing for preventing internal fluid communication between the sets of upper and lower perforations, c. ejecting hot fluids from one of the sets of perforations for melting more bitumen from the tar sands for flowing through the other set of perforations for recovery at the surface and for forming a cavity of a predetermined size around the casing from the upper perforations to the lower perforations, d. pulling out the tubing and packer, e. re-running the tubing with a screen thereon adjacent the other set of perforations and resetting the packer between the two sets of perforations, and f. ejecting a gravel slurry into the cavity from the one set of perforations for forming a gravel pack around the screen adjacent the other set of perforations that is a long lasting gravel pack in tar sands.

13. A method as recited in claim 12 wherein the first step comprises further, a. flowing hot fluids down the annulus past the upper perforations to the lower perforations and back up the tubing for melting the bitumen surrounding the casing to allow formation of the passage in the reservoir from the upper perforations to the lower perforations.

14. A method as recited in claim 12 wherein the third step comprises further, a. ejecting hot fluid from the one of the sets of perforations in the casing into the tar sands for breaking the tar sands down into melted bitumen and bitumen-bare sand, b. flowing the bitumen, bitumen-bare sand, and the hot injected fluids toward the other set of perforations for melting out a cavity of a predetermined size around the casing from the upper set of perforations to the lower set of perforations, and c. flowing the bitumen, bitumen-bare sand, and injected fluids through the other set of perforations for recovery at the surface.

15. A method as recited in claim 12 wherein the third step comprises further, a. ejecting hot fluids from the upper set of perforations in the casing into the tar sands for breaking the tar sands down into melted bitumen and bitumen-bare sand, b. flowing the bitumen, bitumen-bare sand, and the hot injected fluids toward the lower set of perforations for melting out a cavity of a predetermined size around the casing from the upper set of perforations to the lower set of perforations, and c. flowing the bitumen, bitumen-bare sand, and injected fluids through the lower set of perforations for recovery at the surface.

16. A method as recited in claim 12 wherein the third step comprises further, a. ejecting hot fluid from the lower set of perforations in the casing into the tar sands for breaking the tar sands down into melted bitumen and bitumen-bare sand, b. flowing the bitumen, bitumen-bare sand, and the hot injected fluids toward the upper set of perforations for melting out a cavity of a predetermined size around the casing from the lower set of perforations to the upper set of perforations, and c. flowing the bitumen, bitumen-bare sand, and injected fluids through the upper set of perforations for recovery at the surface.

* * * * *